US006855239B1

(12) United States Patent
Jairath

(10) Patent No.: US 6,855,239 B1
(45) Date of Patent: Feb. 15, 2005

(54) PLATING METHOD AND APPARATUS USING CONTACTLESS ELECTRODE

(76) Inventor: Rahul Jairath, 1075 Mazzone Dr., San Jose, CA (US) 95720

( * ) Notice: Subject to any disclaimer, the term of this patent is extended or adjusted under 35 U.S.C. 154(b) by 299 days.

(21) Appl. No.: 10/256,587

(22) Filed: Sep. 27, 2002

(51) Int. Cl.[7] ..... C25D 5/00; C25D 17/00

(52) U.S. Cl. ..... 205/80; 204/193; 204/212; 205/89; 205/137; 205/143; 205/147; 205/148; 205/652; 205/799

(58) Field of Search ..... 205/80, 89, 134, 205/143, 147, 148, 652, 799; 204/193, 212

(56) References Cited

U.S. PATENT DOCUMENTS 6,132,586 A 10/2000 Adams et al.
6,270,646 B1 8/2001 Walton et al.
6,328,872 B1 12/2001 Talieh et al.

OTHER PUBLICATIONS

U.S. Patent Application Publication US 2001/0035354 A1 entitled "Method and Apparatus for Making Electrical Contact to Wafer Surface For Full–Face Electroplating or Electropolishing", Nov. 2001.

Yih, Paul H. et al., "Extending Copper Electroplating to 0.035 Micron Manufacture Node: Plating CU on Ultra Thin Seed" ACM Research Inc., Fremont, CA, no date.

*Primary Examiner*—Robert R. Koehler
(74) *Attorney, Agent, or Firm*—Blakely Sokoloff Taylor & Zafman LLP

(57) ABSTRACT

A plating method and apparatus using contactless electrode is described. In one embodiment an inductive element is placed proximally to a substrate and a moving electromagnetic field generates an emf in the substrate to plate the surface. In another embodiment, a conductive plate is used, so that the conductive plate and the wafer, separated by a dielectric material, operate as two plates of a capacitor when voltage is applied to the conductive plate. The resulting electrostatic field impresses a charge potential on the substrate to plate the surface of the substrate.

41 Claims, 8 Drawing Sheets

PLATING METHOD AND APPARATUS USING CONTACTLESS ELECTRODE

FIELD OF THE INVENTION

This invention relates generally to semiconductor processing and, more specifically, to a method and apparatus for plating metals on a semiconductor wafer.

BACKGROUND OF THE INVENTION

Plating metals by electroplating or electroless plating over a seed layer on a wafer is a common process in the manufacture of semiconductor devices. Requirements for plating processes in semiconductor device manufacturing have become increasingly stringent as device features become smaller and wafer sizes become larger.

One such property is uniform plating across the wafer surface. Another desirable property is to uniformly fill device features (such as vias and trenches) such that no voids exist in the features and the surface of the plated metal is globally planar. Yet another property is to plate metal without damaging the plated metal or any underlying layer. Still another property is for the plating process to be cost effective.

Electro-plating typically involves a rotating wafer with a thin seed layer and an electrolytic bath. Electric potential is applied between an anode and a cathodic wafer, both in contact with the electrolytic bath. Cathodic contact with the wafer may be established using electrical contacts at the wafer edge. Electrolyte flow may be maintained to improve electrolyte transfer to the wafer surface. The applied electric potential drives a current between the anode and cathode, and the metal to be plated is deposited on the wafer.

Electroplating processes known in the art are deficient in several ways. First, thin seed layers tend to be resistive and result in a potential drop between the wafer edge where electrode contact has been established and the wafer center where there is no direct electrode contact. The potential drop causes variations in current density across the wafer surface, which may contribute to poor plating uniformity. The variations are more noticeable as the wafer size increases and the seed layer becomes thinner (which is a prevalent trend in the semiconductor industry). Secondly, features with small dimensional sizes and/or high aspect ratios are often plated with voids in the features and residual topography on the plated metal surface. This is particularly so when the feature size is below 0.18 $\mu$m with an aspect ratio greater than 4 to 1. Thirdly, a large amount of metal may need to be plated for the plating process to be integrated with subsequent processes such as polishing. Since large amounts of metal are first plated and subsequently polished away, the plating and polishing processes represented as an integrated module may be inefficient and costly.

Current density variation across the wafer surface may be reduced by various techniques to improve plating uniformity. One such technique utilizes a porous compressible member which has a conductive surface covering a rotating wafer surface. The porous compressible member, commonly called a sponge, covers a large portion of the surface being plated and distributes current across the surface. Materials used to form the conductive surface on the sponge are metal fillers or conducting polymers such as polyaniline. However, metal fillers may damage the wafer surface as the wafer rotates with respect to the sponge, thereby resulting in poor device yields. Furthermore, conducting polymers, such as polyaniline, lack the structural integrity to withstand the stress caused by rotating the wafer with respect to the sponge.

Another technique utilizes conductive electrical contacts that are formed by pushing conductive wires, pins, brushes or spherical balls against a wafer surface. Several such contacts are utilized to distribute current across the wafer surface. However, pushing such contacts against the wafer surface may damage the plated metal and underlying layers, particularly due to sliding friction when the wafer is rotated with respect to the contacts. Furthermore, such wafer surface damage may result in poor device yields. In some instances, a thin electrolyte layer may be applied between the wafer surface and the electrical contact to reduce the damage. However, the electrolyte layer is conductive and provides a direct path of current flow between the electrical contacts and the anode that may result in poor power and plating efficiency.

Void formation and topography may be reduced by various techniques utilizing a sequence of plating and polishing processes. One such technique is pulse plating. Periodic reversal of the plating voltage electro-polishes a portion of the metal previously plated. Polishing is faster at regions that are higher than surrounding regions on the wafer surface and at regions that have narrower features, where electric currents are higher in magnitude. This technique reduces void formation and local topography within specific regions of the semiconductor device, but generally does not benefit topography globally across the semiconductor device.

Another technique is first plating a wafer and then applying a mask to low regions of the wafer during an electropolishing process. Polishing occurs in high regions that are not masked, increasing planarity of the semiconductor device. However, this technique generally requires two discrete processes and is costly to implement. Another disadvantage of this technique is that the masks utilized are often degraded by the electrolyte itself and may result in poor planarity.

Yet another technique utilizes a bipolar electrode to intermittently plate and polish a wafer surface. The bipolar electrode is arranged so as to facilitate the flow of current from an anode through a portion of an electrolytic solution, through the wafer surface, into another portion of the electrolytic solution, and then into a cathode. Plating occurs in the portion of the wafer surface exposed to the anode and polishing occurs in the portion of the wafer surface exposed to the cathode. Simultaneous plating and polishing occurs to yield a planar surface. However, the polishing action is primarily an electropolishing action and is isotropic such that the resulting surface of the plated metal is locally planar but has poor global planarity. Another disadvantage of this technique is that for plating to be practical, the net plating action may need to be substantially larger than the net polishing action, usually by arranging the bipolar electrode and wafer such that the portion of the wafer surface being plated is substantially larger than the portion being polished. Since the net current flow between the anode and cathode is fixed, this arrangement may lead to current density differences between the two portions of the wafer surface and uneven plating across the wafer surface. Still another disadvantage of this technique is that it increases the path through which current flows from the anode to the cathode. Thus, the capacitance and resistance of the current path is increased making it less responsive to fluctuating currents, such as in pulse plating, and may result in poorly filled features on the wafer surface.

Still another technique involves intermittently applying a polishing force between a pad and the wafer surface during the plating process. Plating and polishing processes occur in different chambers separated by a partition. Polishing occurs in the regions where the polishing action is applied and a globally planar surface is obtained. However, cross-contamination often occurs between the polishing and plating chambers, degrading the quality of the plated metal. Generally, the use of multiple chambers increases complexity of the apparatus resulting in higher costs. Yet another disadvantage of this technique is that obtaining sufficient planarity often requires use of hard pads pushed against the substrate surface with a high force, damaging the plated metal and underlying layers.

Another method for plating metals on a substrate is electroless plating (also called electroless deposition) that involves a wafer immersed in an electroless bath. The wafer surface is typically activated to make it catalytic in nature. The catalyzed surface reacts with the electroless bath to form a metal layer on the wafer surface. Small quantities of the electroless metal itself also acts as a catalyst, so the deposition is autocatalytic once a thin layer of metal has been formed on the original wafer surface. Unlike electroplating, electroless plating is a completely chemical process and does not require electrode placement for material deposition. Accordingly, an apparatus for electroless plating are simpler and usually less costly compared to an electroplating device. Another significant benefit of the electroless process is that it may be used to deposit a metal layer on a non-conducting surface. However, electroless plating rates are significantly slower compared to electro-plating and commercially less viable for many applications. Another disadvantage of electroless plating is that it is a conformal deposition process and suffers from the planarization related disadvantages described above.

Sequential plating and mechanical polishing techniques to form planar surfaces generally require an anode and a cathode for successful plating (as is commonly done in electro-plating systems). These techniques cannot be applied to electroless plating since electroless plating tools do not use anode and/or cathode electrodes. Intermittently applying a pad to the wafer surface during electroless plating may improve planarization, but further reduces effective plating rate of the metal and impacts commercial viability. Therefore, planarization in electroless plated surfaces still pose disadvantages. In addition, electroless plating baths often use environmentally hazardous materials (such as formaldehyde, a known carcinogen) significantly limiting their use in commercial applications. Yet another disadvantage of electroless plating is that since it does not depend on electric currents, it may be a difficult process to regulate.

Accordingly, there is a need for a plating method and apparatus that addresses some or all of the drawbacks of prior art plating techniques.

SUMMARY OF THE INVENTION

A plating method and apparatus using contactless electrode is described. In one embodiment an inductive element is placed proximally to a substrate and when varying current flows through the inductive element, electromagnetic field lines reach the substrate to be plated. The electromagnetic field generates an emf and causes eddy currents along the wafer surface. The induced emf allows plating to be achieved without actual contact of the electrode to the substrate. A dielectric housing isolates the electrode from the surrounding electrolyte used for the plating.

In an alternative embodiment, a conductive plate is used for the contactless electrode. The conductive plate and the wafer, separated by the dielectric material of the housing operate as two plates of a capacitor when voltage is applied to the conductive plate. The resulting electrostatic field impresses a charge potential on the substrate to plate the surface of the substrate.

In various other embodiments, spacers are utilized to separate a plurality of electrodes. The spacer may be made conductive so that it may operate as an anode as well. In other embodiments, power to the various electrodes are separately controlled to control the amount of plating at various regions of the substrate. Still other embodiments mount a polishing device on the dielectric housing of the electrode or on the spacer to polish the substrate surface.

DETAILED DESCRIPTION OF THE EMBODIMENTS OF THE INVENTION

The described embodiments of the present invention address plating a metal (metal being defined herein to include not only the metal, but metal alloy and other compositions having metal that provide metal properties when deposited) layer on a wafer surface or a layer formed on a wafer, using a contactless electrode, having an inductive or capacitive element, to generate current and/or voltage on the wafer surface. Although a semiconductor wafer is used as an example to describe the embodiments herein, other substrates, including a flat panel or magnetic film head, may be used instead. Furthermore, while described embodiments refer to the plating of a metal, the described techniques may be employed to plate a metal, metal alloy, or other conductive materials or layers.

Figure 1:
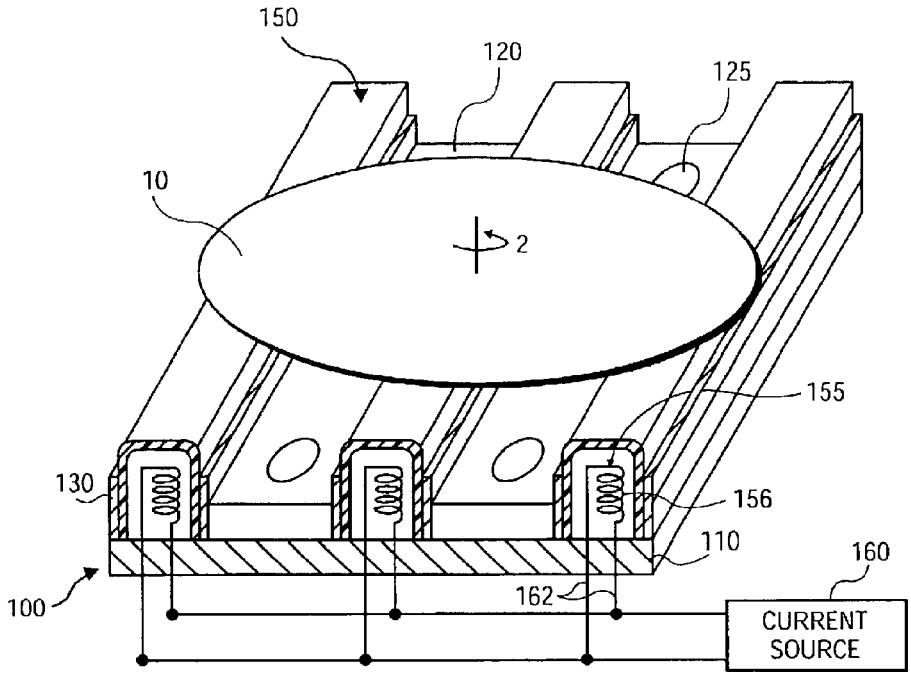
FIG. 1 illustrates a perspective view of an embodiment of the present invention in which a contactless electrode in form of an inductor is employed for plating.
Figure 2:
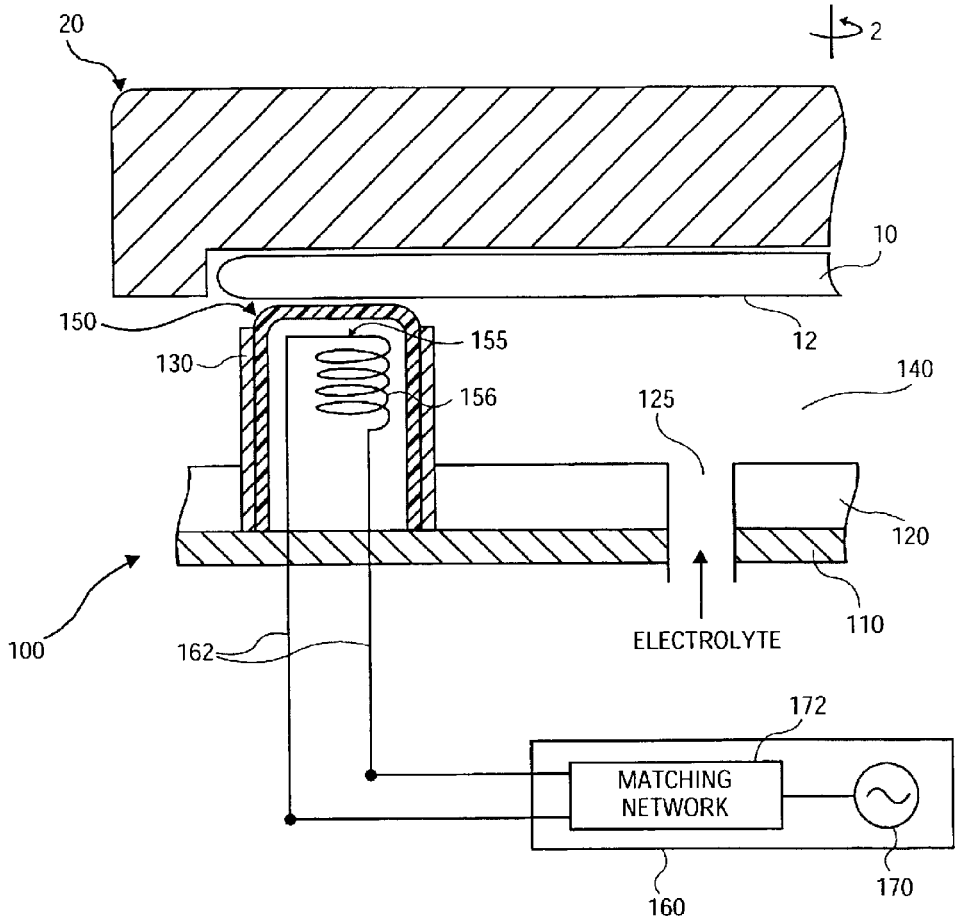
FIG. 2 illustrates a cross-sectional view of a portion of an assembly of FIG. 1.

FIGS. 1 and 2 illustrate a perspective view and a cross-sectional detailed view, respectively, of one embodiment of the present invention. The embodiment is illustrated as assembly 100. A wafer carrier 20 supports a wafer 10 to be plated. A contactless electrode element 155 is disposed within an electrode housing 150 and held in proximity to the wafer 10. In the particular example, the contactless electrode is in form of an inductive element 155. Housing 150 generally resides on a support base, such as support base 110. The electrode housing 150 comprises a dielectric material to electrically isolate the inductive element 155 from the wafer 10 and the electrolyte. One such example material for constructing the housing 150 is an elastomer. As noted the dielectric material is typically interposed between the inductive element 155 and a surface 12 of the wafer 10. The inductive element 155, which is shown as a coil 156 in the example embodiment, is coupled to a current source 160 by conductors 162. Conductor 162 is typically an electrical wire. A varying (or fluctuating) current is generated by the current source 160 and transmitted to the coil 156 to induce an electromagnetic force (emf).

Generally, the assembly is placed in (or is part of) a processing chamber of a tool or equipment, so that the wafer may be introduced into the chamber. In other embodiments, the chamber may be a housing or simply a container to hold a processing liquid. In other embodiments, the chamber may be part of a complex integrated system, such as a cluster tool. The chamber (housing, container, etc) is typically designed to hold a liquid which operates as a plating electrolyte. The environment that the assembly 100 is placed in is not critical to the understanding of the described embodiments of the invention. It is sufficient that some equipment or apparatus houses the assembly 100 and the plating electrolyte used for plating the wafer 10, when the wafer 10 is placed proximally to the assembly 100.

FIG. 2 illustrates one specific example to generate a varying current. In FIG. 2, an alternating current (AC) source 170 is used, along with a matching network 172, as the current source 160. Source 170 generates AC current of a selected frequency and the matching network 160 matches the impedance of the source 170 to lines 162. In other embodiments, current having various waveshape response may be used.

Since the inductive element 155 is arranged as the coil 156, the varying current flowing through the coil 156 generates a magnetic field. The magnetic field responds according to the current waveform. Since the coil 156 is placed in proximity to the wafer surface 12, the magnetic field intersects the wafer surface 12. The varying current is of a value sufficient to have the field lines of the electromagnetic field extend at least to the wafer surface 12. Typically, the field lines extend into the wafer 10. The changing electromagnetic field induces an electromotive force (emf) that generates a surface current on the wafer surface 12, which then causes the metals in the electrolyte to plate the wafer surface 12.

It is noted that the surface current is a result of energy transfer from the coil 156 to the wafer 10 by the action of the generated electromagnetic field of coil 156 and the induced emf in the wafer 10. From a functional standpoint, surface currents on the wafer surface 12 are similar to eddy currents induced by electromagnetic field. Skin effects similar to those in eddy current systems occur on the wafer surface and concentrate the generated surface current along the surface where the metal is to be plated. The surface current increases the surface energy of the wafer surface and creates chemically active sites across regions of the wafer surface 12. Metal ions of the material being plated are reduced to metal at these sites to form a metal (or other conductive) layer on the wafer surface, which may be the wafer substrate itself or a layer formed on the wafer.

Varying the current induces an emf throughout the apparatus. The inductive element 155, which operates as the electrode, may be arranged to concentrate the electromagnetic field towards the wafer surface 12. In order to direct the induced magnetic field lines, a shield 130 may be disposed adjacent to the electrode to direct the electromagnetic field lines towards the wafer surface 12. In one embodiment, the shield 130 may comprise a ferromagnetic material, such as steel, to contain the magnetic field lines. The dielectric material of the housing 150 isolates the inductive element 155, but does not contain the magnetic field lines. Furthermore, as shown in FIG. 1, multiple electrodes may be arranged adjacent one another and the separation may be achieved by the use of spacers 120. As noted the electrode housing 150, shields 130, and spacers 120 may be supported on a plate 110.

An electrolyte containing ions of the metal (or metal alloy) to be plated, is introduced into a process region, such that it is in fluid contact with the electrode assembly 100 and wafer surface 12. In one embodiment, openings 125 in the spacers 120, as well as plate 110, may be used to introduce electrolyte into a process region 140. The openings 125 may be distributed across the electrode assembly 100 to distribute the electrolyte uniformly within the process region 140. The electrolyte 30 flows from the electrode assembly 100 towards the wafer surface 12 to deliver the electrolyte to the wafer surface 12. The wafer 10 may be rotated about an axis 2 to create a pumping action and further improve electrolyte flow towards the wafer surface 12 and to create an outward flow of the electrolyte towards the wafer edge along a direction parallel to the wafer surface 12. Therefore, fresh electrolyte may be constantly introduced to replenish throughout the wafer surface 12. It is to be appreciated that other techniques for introducing the electrolyte may be implemented.

The above-described plating method is unlike prior art electro-plating methods. Unlike some prior art electroplating methods, plating is achieved without conductive electrical contact of an electrode having electrical contact with the wafer surface. The electrode element 100 does not contact the wafer, but rather induces current flow by inducing emf proximal to the wafer surface 12. Elastomers, and other dielectric material, including those well known in the art to polish semiconductor wafers without damaging the wafer surface, may be used to protect the wafer surface from the inductive element 155. Therefore, the wafer surface is free of damage from physical contact with an electrode. Furthermore, unlike prior art electro-plating techniques, current flow in the wafer surface occurs without flow of current between the wafer surface and an anode electrode. Unlike prior art electro-plating techniques, the presence of an anode is not a necessary condition to plate material onto the wafer, although an anode may still be present (as described in reference to FIG. 3). Therefore, complexity and costs of the apparatus may be reduced by not having such contact electrodes.

The above-described plating method is also unlike prior art electroless plating methods. Unlike electroless plating, current flow occurs in the wafer surface with the induced emf technique. The above-described plating occurs in those portions of the wafer surface that are in the magnetic field created by the induced emf, which allows the plating process to be easily regulated.

Furthermore, depending on the selected design, multiple electrodes may be utilized and arranged so as to be in proximity to various portions of the wafer surface and induce surface currents uniformly across the wafer surface. Accordingly, FIG. 1 shows multiple electrode housings 150 arranged in a row, separated by spacers 120. The housing 150 may contain one or multiple inductive elements 155, such as coil(s) 155. Uniform surface current distribution allows uniform distribution of chemically active sites on the wafer surface 12, which then allows uniform metal plating across the wafer surface 12. Plating uniformity may be further improved by providing for a relative motion between the wafer surface 12 and electrode assembly 100. Relative motion may be obtained by coupling the wafer carrier 20 to a device or equipment (not shown) to rotate the wafer 10 about an axis 2. Relative motion may also be obtained by mounting the electrode assembly on equipment (not shown) so as to oscillate it along a longitudinal direction. Thus, some form of movement that agitates the electrolyte and/or causes relative movement between the wafer and the electrolyte may assist in plating uniformity.

In the design of the inductive element 155, consideration may be given to how the electrode influences the manner in which surface current is induced on the wafer surface. As noted, the shown example uses an inductive element that may be arranged as one or more coils 156. Coil shape, size and orientation are factors that may influence the induced surface current. To reduce magnetic hysteresis, the coil may be made of a non-ferrous material, such as copper. The coil may be wire wound in a helical manner in the form of a cylindrical tube. The coil may also be formed around a length of a cylindrical tube (not shown) to hold the coil rigidly in place, which may reduce variations in plating uniformity caused by instability in the coil itself. Alternatively, the coil may comprise a wire wound in a planar configuration. Other shapes, sizes and designs may be used. The number of turns of the coil is another factor which may determine the strength of the magnetic field and the surface current. In one embodiment about five (5) to one hundred (100) turns of copper wire may be used. However, a different number of turns may be utilized depending on the design, material and the size of the wire. A single turn may suffice in some applications, but generally multiple turns are utilized. Although a coil has been described in terms of a wire wound in a helical manner, it is understood that the coil may be arranged in different planar or non-planar configurations.

Varying current is provided to the inductive element 155 by the current source 160. The current source comprises a varying current generator, such as the AC current source 170 shown in FIG. 2. Pulsed generators may be used as well. The impedance matching network 172 matches the output impedance of the current generator to the input impedance of the inductive element A number of current generator are commercially available for current source 160. One example is a generator from Advanced Energy Industries, Inc. of Fort Collins, Colo. Another is from Dynatronix, Inc. of Amery, Wis. Depending on the application, the impedance matching network may not be necessary. For example, when the frequency of the current source is less than about 1 kHz, an impedance matching network may not be necessary.

The waveform applied to the coil 156 may be sinusoidal, triangular-wave or square-wave, or even a pulse. The frequency is generally assigned and the bandwidth is typically narrow. Other waveform patterns may also be used. Appropriate frequency or frequencies of the current may be chosen such that the induced surface current is sufficient to plate metal on the wafer surface. Generally, higher the frequency, higher the effect of confining surface current towards the surface of the wafer being plated. This effect is particularly beneficial when the metal layer on the wafer surface is thin and resistive (for example at the start of the plating process) since sensitivity to such metal layers is increased. In one embodiment, the frequency of the current is approximately on the order of 10 MHz, but may be in the range of 1 kHz to 50 MHz depending on the application, characteristics of the wafer surface, electrolyte, etc. In certain applications, it may be advantageous to use microwave power. In addition, the waveform of the current may be adjusted depending on the specific design of the electrode assembly, electrolyte, desired properties of the copper being plated, etc.

In certain processes power dissipation may be a concern, which may require lower current values to be used. Frequency also affects power dissipation since reactance is present in the contactless electrode element In some instances, power dissipation may be controlled by controlling the duty cycle of the waveform. In other processes, it may be desirable to plate on conducting layers with poor spatial uniformity of conductivity due to variations in grain structure, uneven heat treatment, etc. These, and other such processes may be tailored by appropriate combination and adjustment of the coil properties and circuit parameters of the generated current Once the electrolyte is introduced into the process region 140, the plating sequence may begin. Even though the electrolyte may be corrosive and/or conductive, the dielectric material of the housing 150 protects the encased inductive element 155. The dielectric material may be selected from a non-porous material to provide corrosion resistance (e.g. urethane or ceramics) as well or a coating may be placed on the dielectric material (such as Teflon™ coating) for the corrosion resistance.

Figure 3:
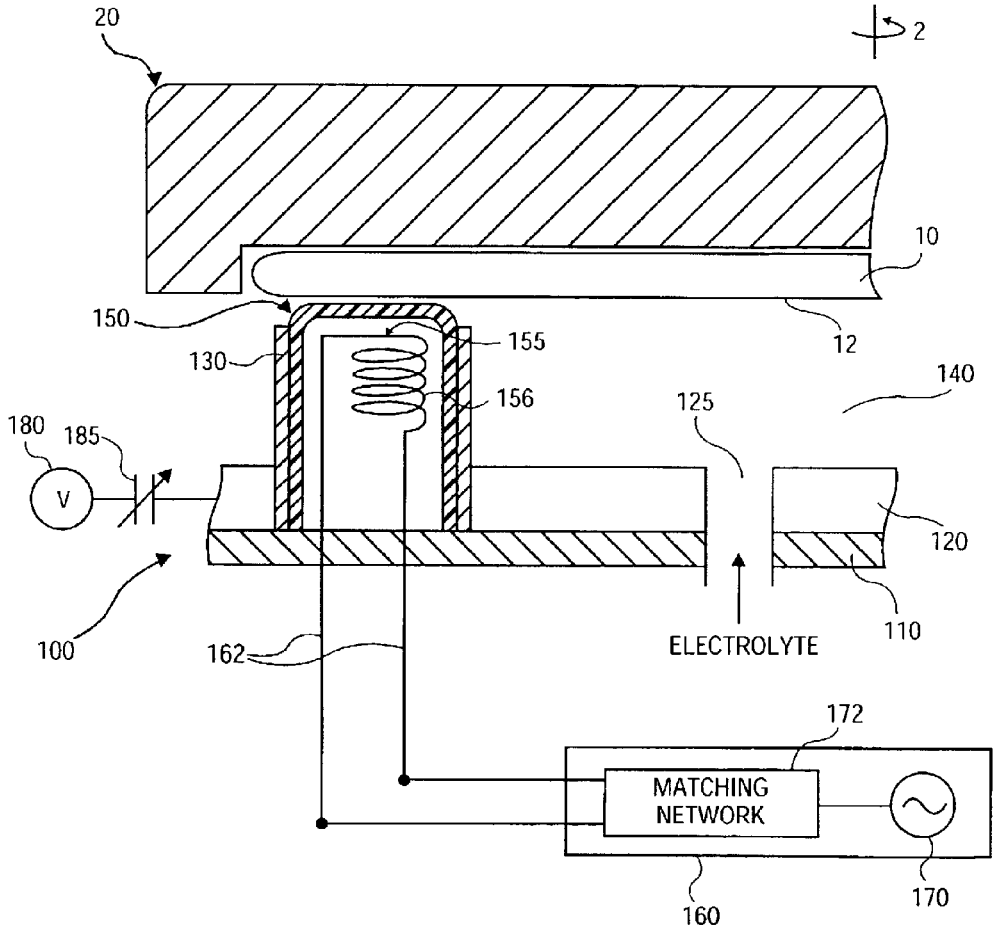
FIG. 3 illustrates a cross-sectional view of another embodiment of the present invention in which spacers are made conductive to operate as an added anode.

Referring to FIG. 3, an alternative embodiment is shown in which the spacers 120 are used as an anode as well. The spacers 120 may be arranged as an anode to apply a potential and drive a current through the electrolyte to the wafer surface. In this embodiment, the spacers 120 are fabricated using a conductive material and coupling a voltage source 180 to the spacers 120. A variable capacitor 185 may be used in some embodiments to control the voltage coupling between the anode spacer and the wafer surface, which now operates as a cathode. Typically, the wafer 10 may be coupled to electrical ground for the cathodic potential. The grounding may be achieved through the wafer carrier 20. It is to be noted that depending on the process being run, the anode-cathode positions may be reversed between the spacer 120 and the wafer 10. Although the presence of an anode is not a necessary condition for plating, the added anodic potential may have the effect of further exciting the wafer surface, and advantageously increasing the plating rate. It is to be noted that the anode is provided by the spacer 120 in the particular example. In other embodiments, an anode may be provided by other structures, so that an anode potential is present proximal to the inductive element(s) 155.

Figure 4:
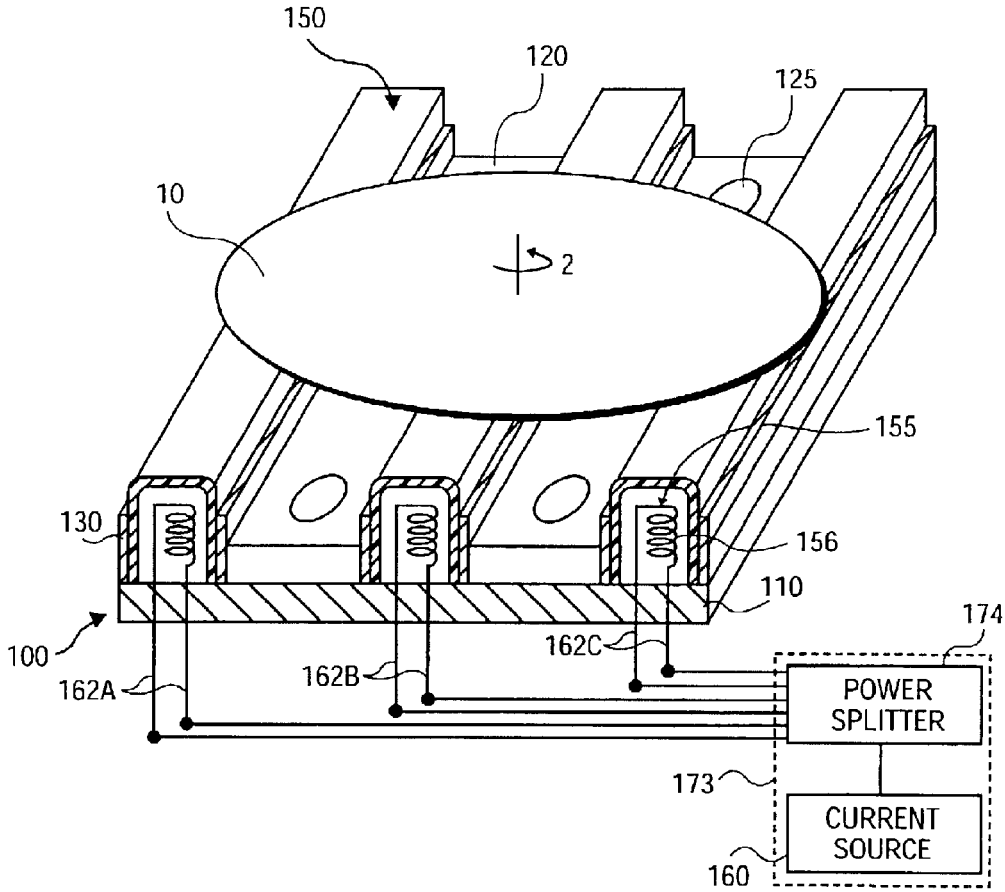
FIG. 4 illustrates a perspective view of another embodiment of the present invention in which power to the electrodes are independently controlled.

In FIG. 4 a perspective view of another alternative embodiment of the invention is shown. The electrode assembly comprises multiple, independently controlled inductive elements 155. Independent current control to various inductive elements 155 allow for local adjustment of the emf to control surface current at selected regions of the wafer 10. By appropriate application of the local control, a center-to-edge uniformity of the plated metal may be improved. In the example illustration of FIG. 4, a power splitter 174 is coupled between the current source 160 and the various coils 156. Power splitter 174 splits the current to the coils 156 and the split current may be controlled separately and independently to make the individual adjustments of the emf at the coils. The two units 160 and 174 may be combined as a single electrical network 173, and the adjustment may be achieved by computer control. Alternatively, separate current generators may be used instead of the splitter 174.

Thus, the inductive elements 155 may be further segmented into multiple independently controlled sections to provide a further control of the center-to-edge uniformity of the plated metal. The degree of independent control available depends on the amount of local emf generation control desired. Generally, localized control of the surface current may be achieved with an electrical network that balances the current(s) generating the emf, such that the surface currents in the wafer provide uniform plating. The electrical network may comprise multiple, independently controlled current sources (not shown) and impedance matching networks (not shown) or a power splitter 174. Alternatively, localized control of the surface current may be achieved by adjusting electrode characteristics such as inductive element size, orientation, configuration (capacitively or inductively coupled), etc. However, these types of adjustment are more permanent, as compared to current adjustments. In other embodiments the anode design of FIG. 3 may be combined for use as well.

Figure 5:
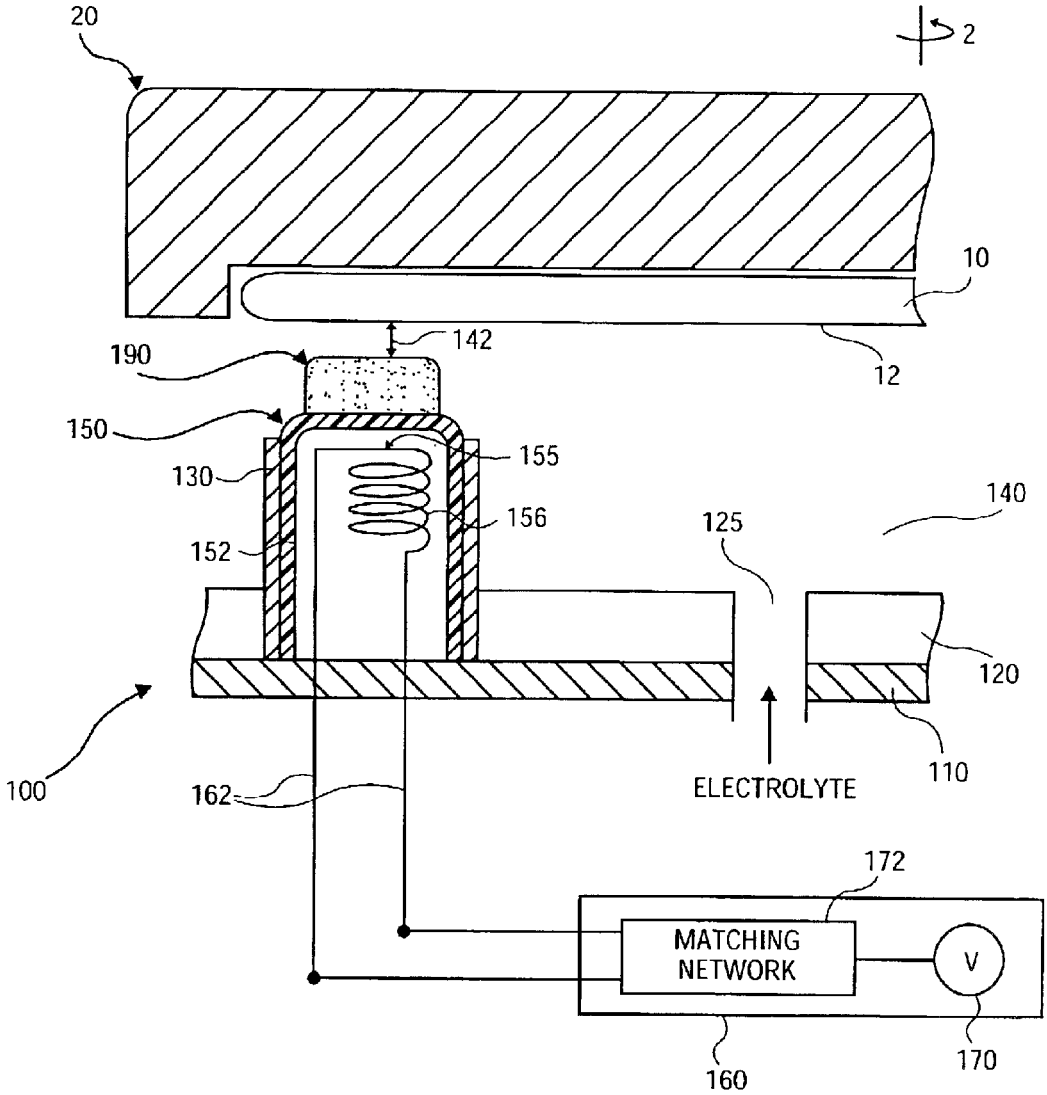
FIG. 5 illustrates a cross-sectional view of another embodiment of the present invention in which a polishing device is disposed over an electrode housing.
Figure 6:
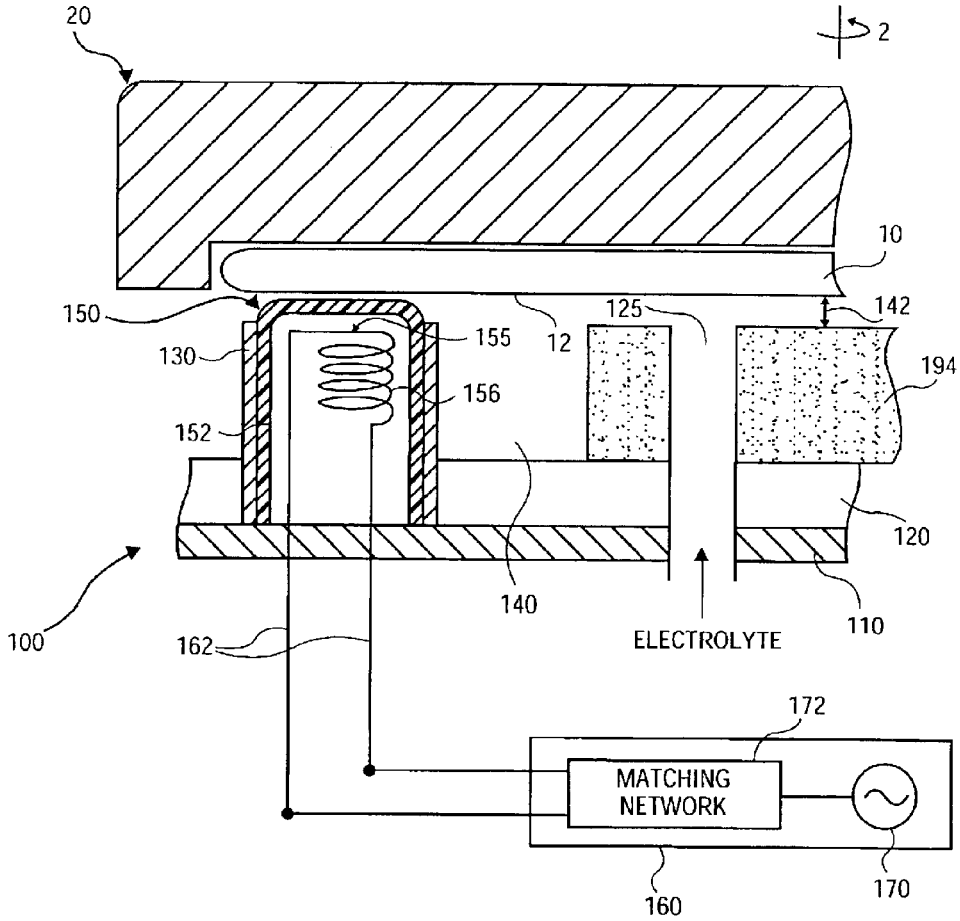
FIG. 6 illustrates a cross-sectional view of another embodiment of the present invention in which a polishing device is disposed over the spacer.

Referring to FIGS. 5 and 6, cross-sectional views of still other embodiments of the present invention are illustrated. In FIG. 5, a polishing device 190 is shown attached atop housing 150, so that the polishing device 190 is in close proximity to the wafer surface 12. When relative motion is provided between the wafer and the electrode assembly, polishing of the wafer surface occurs. In operation, it is to be noted that the polishing device is in polishing contact with the wafer surface 12. Use of the polishing device in polishing contact with the wafer surface advantageously permits a higher degree of planarization of the wafer surface during plating.

Although a variety of polishing (or planarizing) devices may be utilized, the polishing device 190 generally comprise a material that is sufficiently flexible so as to adjust to geometric imperfections across the wafer during polishing and does not damage the wafer surface or underlying layers. Accordingly, one polishing device is a polishing pad, including those pads fabricated using a polymeric material. Such polymeric materials are well known in the art, and are available commercially. For example, non-conductive polymers such as urethane are commonly used to fabricate pads used to polish silicon substrates. Such pads are available from Rodel Products Corporation in Scottsdale, Ariz. The pad may also be fabricated using polyvinyl alcohol (PVA). Alternatively, pads may be fabricated using conductive polymers. One such material is elastomeric foam doped with conductive material such as metallic, conducting carbon or aniline filler. The filler size is typically on the approximate order of 100 nm, but may be in the approximate range of 10 nm to about 1000 nm depending on the material being polished, process conditions, and electrolyte viscosity. Another such material is an inherently conductive polymer also referred to in the art as organic metal. Examples of such materials are polymers comprising polythiopenes, polypyrroles, polyaniline, polyphenylenevinylenes, or polydialkylfluorenes, or their derivates.

Polishing contact may be obtained by pushing the polishing device against the wafer surface. The polishing device 190 does not necessarily have to be isolated within a polishing chamber and separated from the plating process region by a partition. A gap 142 may be maintained between the polishing device 174 and the wafer surface 12, so as to further reduce damage to the wafer surface while obtaining the polishing action.

Instead of arranging the polishing device 190 on the housing 150, FIG. 6 illustrates an alternative embodiment in which the polishing device is arranged on the spacer 120. In FIG. 6, a polishing device 194 is shown residing on the spacer 120. The polishing device 194 operates equivalently as polishing device 190. As noted, an opening may be present in the polishing device for the flow of electrolyte. The opening may coincide with opening 125 of the spacer 120.

Figure 7:
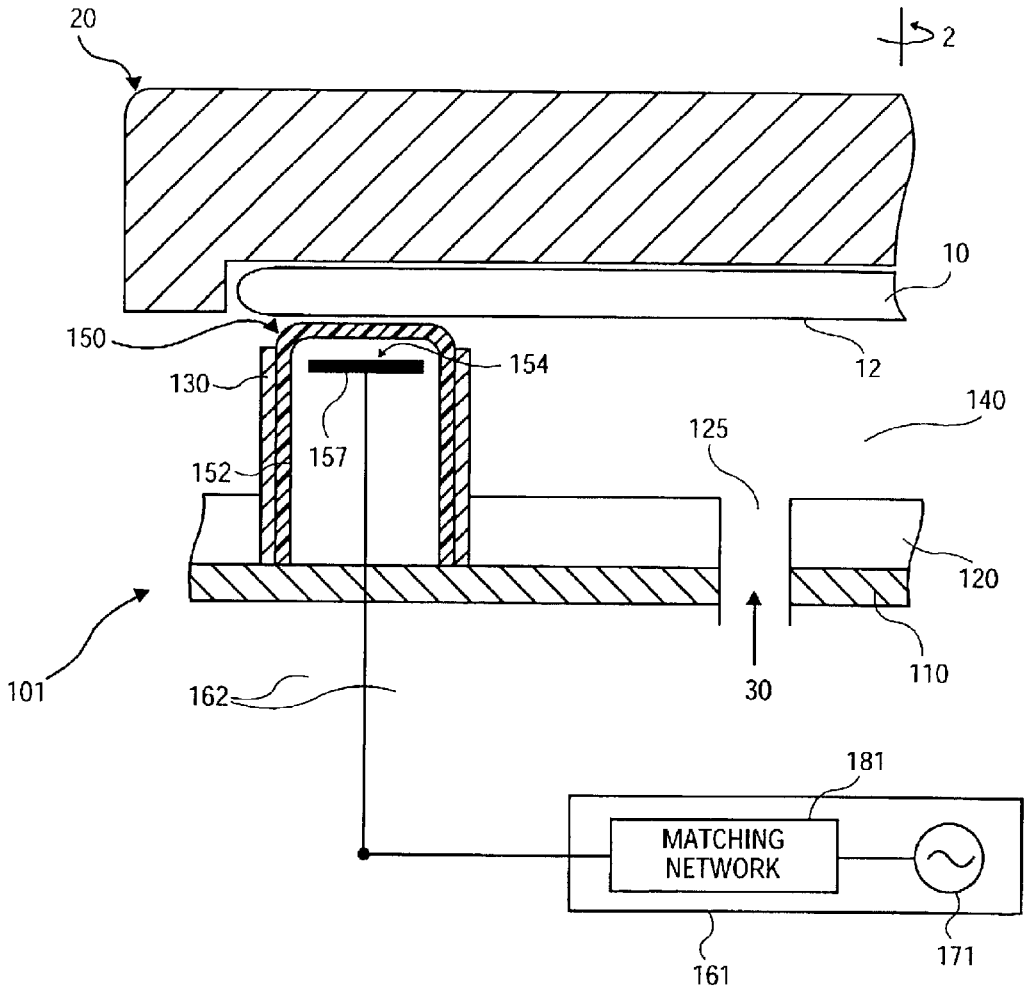
FIG. 7 illustrates a cross-sectional view of an embodiment of the present invention in which a contactless electrode in form of a capacitor plate is employed for plating.

Referring to FIG. 7, an alternative contactless electrode arrangement and technique is shown. Assembly 101 is equivalent to assembly 100 shown in FIG. 2, but with the exception that a different electrode element is used. Instead of an inductive element 155, a capacitive element 154 is employed. As shown in the embodiment illustrated in FIG. 7, a conductive plate 157 may be used for the capacitive element 154. Conductor 162 couples the plate 157 to a voltage source 161, which comprises a varying voltage source 171 and an impedance matching network 181. The impedance matching network 181 may not be needed and functions similar to the matching network 172 of FIG. 2.

The voltage source 171 sources a voltage (which may also be a varying voltage) to the conductive plate 157. Frequencies and waveforms, similar to that described for the inductive element 155, may be implemented. Instead of generating an emf from the coil, the conductive plate 157 operates similar to one plate of a capacitor. The other plate of the capacitor is mimicked by the wafer 10. Thus, plate 157, wafer 10 and the interposed dielectric form a capacitive arrangement.

When voltage is applied to the plate from voltage source 171, an electrostatic field extends from the plate to the wafer surface 12. Varying the voltage changes the charge on the plate 157, which causes a responsive change in the accumulated charge on the wafer surface 12. Thus, voltage is impressed at the surface 12. The presence of the charge potential on the wafer surface then allows plating to occur with the presence of the appropriate electrolyte. Thus, instead of using an electromagnetic field to generate plating activity on the wafer surface, assembly 101 of FIG. 7 uses an electrostatic field to achieve the plating on the wafer surface.

Although only the one embodiment is shown for the capacitive arrangement for the contactless electrode in FIG. 7, various embodiments as noted in reference to FIGS. 3–6 for the inductive element 155, may also be used as well for the capacitive element 154. Thus, spacers (including those that are made conductive to operate as an anode), power splitters, polishing devices, etc., described in reference to the inductive element, may be used as well with the capacitive element. Anode voltage may be coupled proximal to the capacitive element 154, as well. Accordingly, electromagnetic or electrostatic field coupling to the wafer may be used to plate metal material on the wafer surface.

Figure 8:
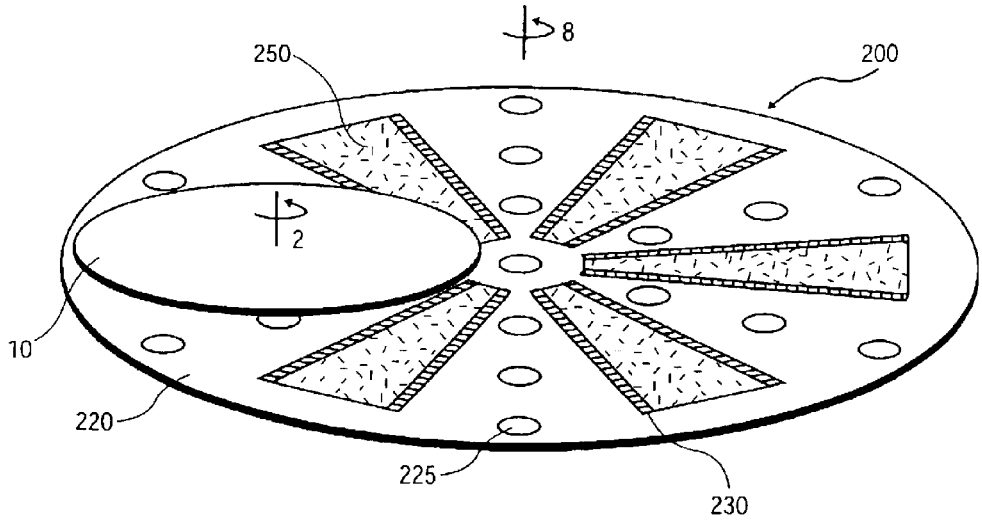
FIG. 8 illustrates a perspective view of a contactless electrode assembly in which the electrodes are arranged in a radial pattern.

FIG. 8 illustrates a perspective view of an electrode assembly 200 in accordance with the embodiments of the present invention. The electrode assembly 200 includes either an inductive or capacitive element as described earlier in reference to the FIGS. 1–7. In the arrangement of FIG. 8, multiple electrodes 250 are shown in a radial pattern, emanating from the center of a circular shaped assembly. The illustration also shows the presence of spacers 220, shields 230 and electrolyte flow openings 225. These features correspond to spacers 120, shield 130 and flow openings 125. The electrode assembly may rotate about an axis 8 and the wafer 10 may rotate about its parallel axis 2. Plating occurs when power source(s) are applied. Although the diameter of the assembly 200 is shown much larger than the wafer 10, it need not be. The two may be of the same diameter or the diameter of electrode assembly 200 may be smaller than the diameter of the wafer 10.

Figure 9:
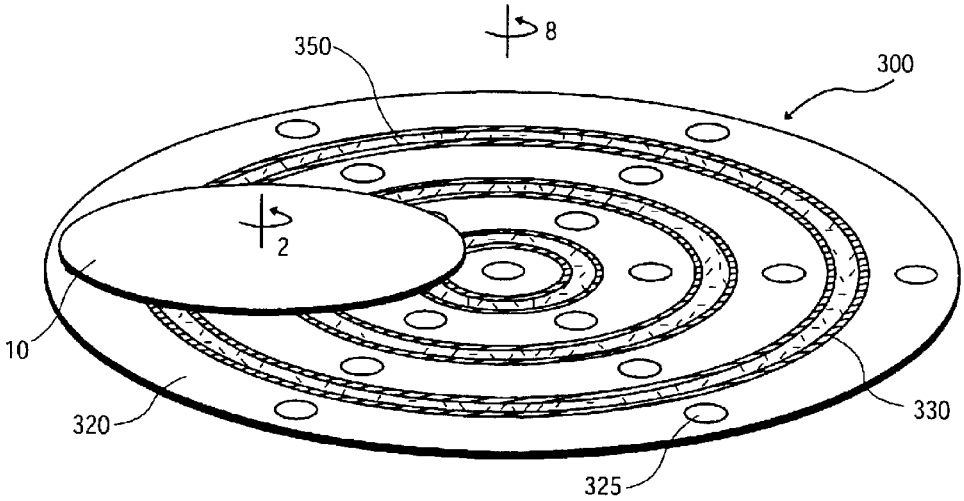
FIG. 9 illustrates a perspective view of a contactless electrode assembly in which the electrodes are arranged in a concentric circular pattern.

FIG. 9 illustrates a perspective view of another embodiment of an electrode assembly. Electrode assembly 300 with contactless electrode 350, spacers 320, shield 330 and flow openings 325 is equivalent to the assembly 200 of FIG. 8. Instead of a radial pattern, the electrodes of assembly 9 are arranged in a concentric circular pattern. In this arrangement, multiple electrodes are concentrically arranged within the electrode assembly 300. The electrode assembly 300 may rotate about the axis 8 and/or the wafer 10 may rotate about its parallel axis 2. Again, the diameter of the assembly 300 is shown much larger than the wafer 10, it need not be. The two may be of the same diameter or the diameter of electrode assembly 300 may be smaller than the diameter of the wafer 10. It is to be noted that various other patterns may be designed and employed. The various patterns allow for different electrode coverage on the wafer surface.

Thus, a plating apparatus and method using contactless electrode is described. While the embodiments of the present invention have been described in terms of specific examples (coils and conductive plates), numerous alternatives, modifications and variations may be practiced within the scope and spirit of the described embodiments. The described embodiments may be practiced on various substrates, including semiconductor substrates (such as silicon wafers), to plate a conductive material (such as metal) on the substrate itself or on a layer formed on the substrate.

I claim:

1. An apparatus comprising:

an inductive element to be positioned proximal to a substrate so that when current flows through said inductive element, an electromagnetic field induces an electromotive force to generate a surface current on the substrate and when in presence of an electrolyte, the surface of the substrate is plated; and a housing to contain said inductive element therein and isolate said inductive element from the electrolyte.

2. The apparatus of claim 1 further including a current source to generate a varying current.

3. The apparatus of claim 2 further including a matching network to impedance match said current source to said inductive element.

4. The apparatus of claim 1 wherein said inductive element is a coil.

5. The apparatus of claim 1 further including a plurality of said inductive elements and respective housings, in which spacers are disposed between said housings to separate said inductive elements.

6. The apparatus of claim 5, wherein said spacers have openings to allow introduction of the electrolyte.

7. The apparatus of claim 5 wherein said plurality of inductive elements are coupled to have different current values to separately control values of the induced electromotive force.

8. The apparatus of claim 5 further including conductive shields disposed along sidewalls of said housing to confine direction of the electromagnetic field towards the substrate.

9. The apparatus of claim 5 wherein, said spacers are conductive in order to operate as an anode when coupled to a voltage source.

10. The apparatus of claim 1, wherein an anode voltage is present proximal to said housing.

11. A plating apparatus comprising:

an inductive element to be positioned proximal to a substrate so that when current flows through said inductive element, an electromagnetic field induces an electromotive force to generate a surface current on the substrate and when in presence of an electrolyte, the substrate or a layer formed on the substrate is plated with a conductive material; and a housing constructed from a dielectric material to contain said inductive element therein and isolate said inductive element from the electrolyte.

12. The apparatus of claim 11 further including a plurality of said inductive elements and respective housings, in which spacers are disposed between said housings to separate said inductive elements in a pattern.

13. The apparatus of claim 12 wherein said inductive elements and corresponding spacers are arranged in a radial pattern.

14. The apparatus of claim 12 wherein said inductive elements and corresponding spacers are arranged in a concentric circular pattern.

15. The apparatus of claim 12 wherein said inductive element is a coil.

16. The apparatus of claim 12, wherein said spacers have openings to allow introduction of the electrolyte.

17. The apparatus of claim 12 wherein, said spacers are conductive in order to operate as an anode when coupled to a voltage source.

18. The apparatus of claim 12 wherein said plurality of inductive elements are coupled to have different current values to separately control values of the induced electromotive force.

19. The apparatus of claim 12 further including conductive shields disposed along sidewalls of said housing to confine direction of the electromagnetic field towards the substrate.

20. The apparatus of claim 12 further including a polishing device atop said housing or said spacer to polish the surface.

21. An apparatus comprising:

a capacitive element to be positioned proximal to a substrate so that when voltage is applied to said capacitive element, an electrostatic field extends to a surface of the substrate to generate a potential on the surface of the substrate and when in presence of an electrolyte, the surface of the substrate is plated; and a housing constructed from a dielectric material to contain said capacitive element therein and isolate said capacitive element from the electrolyte.

22. The apparatus of claim 21 wherein, said capacitive element in said housing is a conductive plate so that the conductive plate and the substrate, separated by the dielectric material of said housing, operate equivalent to a capacitor.

23. The apparatus of claim 22 further including a plurality of said conductive plates and respective housings, in which spacers are disposed between said housings to separate said conductive plates.

24. The apparatus of claim 23, wherein said spacers have openings to allow introduction of the electrolyte.

25. The apparatus of claim 23 wherein said plurality of capacitive elements are coupled to have different voltage values to separately control values of the voltage coupled to various surface regions of the substrate.

26. The apparatus of claim 23 further including conductive shields disposed along sidewalls of said housing to confine direction of the electrostatic field towards the substrate.

27. The apparatus of claim 23 wherein, said spacers are conductive in order to operate as an anode when coupled to an anode voltage source.

28. A plating apparatus comprising:

a capacitive element to be positioned proximal to a substrate so that when voltage is applied to said capacitive element, an electrostatic field extends to a surface of the substrate to generate a potential on the surface of the substrate and when in presence of an electrolyte, the substrate or a layer formed on the substrate is plated with a conductive material; and a housing constructed from a dielectric material to contain said capacitive element therein and isolate said capacitive element from the electrolyte.

29. The apparatus of claim 28 wherein, said capacitive element in said housing is a conductive plate so that the conductive plate and the substrate, separated by the dielectric material of said housing, operate equivalent to a capacitor.

30. The apparatus of claim 29 further including a plurality of said capacitive elements and respective housings, in which spacers are disposed between said housings to separate said capacitive elements in a pattern.

31. The apparatus of claim 30 wherein said capacitive elements and corresponding spacers are arranged in a radial pattern.

32. The apparatus of claim 30 wherein said capacitive elements and corresponding spacers are arranged in a concentric circular pattern.

33. The apparatus of claim 30, wherein said spacers have openings to allow introduction of the electrolyte.

34. The apparatus of claim 30 further including a polishing device atop said housing or said spacer to polish the surface.

35. A method of plating comprising:

placing a substrate surface to be plated proximal to a contactless electrode assembly in which an electrode element is disposed within a dielectric housing to isolate the electrode element from a plating electrolyte;

introducing the plating electrolyte containing a plating chemistry to plate a surface of the substrate;

applying power to the electrode to emanate an electromagnetic or electrostatic field which extends at least to the surface of the substrate; and inducing voltage at the surface to plate a conductive material onto the surface.

36. The method of claim 35 wherein, the electrode element is an inductive element to emanate the electromagnetic field to induce electromotive force at the surface.

37. The method of claim 36 further including the applying of current to a plurality of inductive elements in which different current values are applied to respective inductive elements to control the amount of plating at respective locations of the surface.

38. The method of claim 35 wherein, the electrode element is a capacitive plate to emanate the electrostatic field to induce charge potential at the surface.

39. The method of claim 38 further including the applying of voltage to a plurality of capacitive plates in which different voltage values are applied to respective capacitive plates to control the amount of plating at respective locations of the surface.

40. The method of claim 35 further including coupling of anode voltage proximal to the dielectric housing.

41. The method of claim 35 further including polishing of the surface.

* * * * *